US006782678B1

(12) United States Patent
Bodereau

(10) Patent No.: US 6,782,678 B1
(45) Date of Patent: Aug. 31, 2004

(54) STACKING DEVICE AND PRINTED SECTIONS IN THE FORM OF CARTRIDGES

(75) Inventor: Jean-Pierre Bodereau, La Ferte Bernard (FR)

(73) Assignee: Realisations, Etudes & Co Commercialisation de materiel pour l'Industrie, RECMI, La Ferte Bernard (FR)

( * ) Notice: Subject to any disclaimer, the term of this patent is extended or adjusted under 35 U.S.C. 154(b) by 0 days.

(21) Appl. No.: 09/674,007

(22) PCT Filed: Apr. 23, 1999

(86) PCT No.: PCT/FR99/00975

§ 371 (c)(1),
(2), (4) Date: Mar. 9, 2001

(87) PCT Pub. No.: WO99/55611

PCT Pub. Date: Nov. 4, 1999

(30) Foreign Application Priority Data

Apr. 25, 1998 (FR) ..... 98 05145

(51) Int. Cl.[7] ..... B65B 35/30; B65B 13/06

(52) U.S. Cl. ..... 53/542; 53/156; 53/589; 100/7; 271/181; 271/214

(58) Field of Search ..... 53/542, 156, 157, 53/589; 271/181, 214, 218; 100/7

(56) References Cited

U.S. PATENT DOCUMENTS

| | | | | | |
|---|---|---|---|---|---|
| 3,648,431 | A | * | 3/1972 | Hartbauer et al. | 53/542 |
| 4,611,705 | A | * | 9/1986 | Fluck | 53/542 |
| 4,723,883 | A | * | 2/1988 | Smith | 100/7 |
| 4,772,003 | A | * | 9/1988 | Nobuta et al. | 271/181 |
| 4,824,093 | A | * | 4/1989 | Belden | 271/216 |
| 5,515,667 | A | * | 5/1996 | Roosli | 53/542 |
| 6,003,860 | A | * | 12/1999 | von Aesch et al. | 271/214 |

FOREIGN PATENT DOCUMENTS

| | | | | |
|---|---|---|---|---|
| AT | 393820 B | * | 12/1991 | B65B/27/02 |
| CH | 607979 A5 | * | 12/1978 | B65H/31/06 |
| EP | 0623542 A1 | * | 11/1994 | B65H/31/06 |
| EP | 0709330 A2 | * | 5/1996 | B65H/31/30 |
| EP | 0741101 A2 | * | 11/1996 | B65H/31/30 |
| JP | 59036066 A | * | 2/1984 | B65H/33/02 |
| WO | WO 9529865 | * | 11/1995 | B65H/29/00 |

* cited by examiner

*Primary Examiner*—Stephen F. Gerrity
(74) *Attorney, Agent, or Firm*—Young & Thompson

(57) ABSTRACT

The present invention relates to an automatic device for the horizontal stacking and transfer of booklets in the form of bundles of stacked booklets. The invention consists in that the device comprises a transfer unit coacting with a distribution unit for plates which permit it to operate at high speeds. Use in the stacking and transfer of booklets in the form of bundles, at high speed.

12 Claims, 7 Drawing Sheets

STACKING DEVICE AND PRINTED SECTIONS IN THE FORM OF CARTRIDGES

Figure 1A:
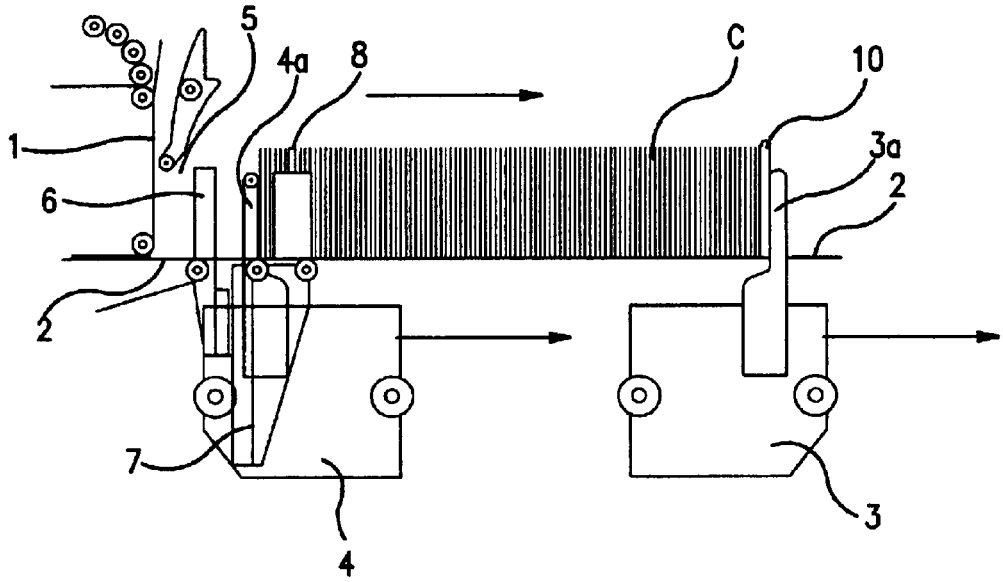

The present invention has for its object an automatic device for stacking and transfer of printed booklets in the form of bundles of said booklets which are then packaged, preferably by banding, then palletized for shipment. The invention relates more particularly to a horizontal stacking device for printed booklets that can operate at very high rates of speed.

In a device of this type, each movable element has its own cycle time. The cycle of a movable element is defined by the series of movements that it carries out and the cycle time is the time needed to carry out this series of movements and return to its initial condition. Each movable element has a minimum cycle time and the minimum cycle time of the complete device is thus the longest of all the minimum cycle times of the movable elements constituting the device. Also, the development of a device that can function at high speed consists in obtaining a device having the shortest cycle time possible.

In a stacking and transfer device for printed booklets in the form of bundles, the longest cycle always is that of the pressing and transfer elements of the stacked bundle toward a packaging device.

The minimum cycle time of such a stacking and transfer device is thus the time required for the transfer elements of the booklets to press and to transfer the bundle of the stacked portion toward a packaging device and to return to their initial condition.

There are known installations for the processing of printed booklets permitting their horizontal stacking and their transfer in line in the form of bundles, in which a pressing carriage movable below the stacking table and constituted by two elements connected by jacks, permits gripping a formed bundle of booklets to bring it to a packaging station, in particular by banding, said bundle being raised by said carriage in the course of its transfer. Another movable carriage below the stacking table, provided with stacking fingers, ensures the holding of a new bundle in the course of formation. The bundle preferably receives a plate at the front during the appearance of a new bundle and is then carried by the pressing carriage toward a dispensing station for a second plate, counterfingers being brought against the rear of the bundle so as to be able to retract the pressing carriage and to form a space between said counterfingers and the pressing carriage in which is inserted a second plate.

In addition to the problem of dirtying the booklets connected to the presence of the counterfingers, the processing time is relatively long because particularly the advance of the pressing carriage and its return during insertion of the rear plate. Moreover, the emplacement of the first plate coming directly on the new bundle in formation, in the case of high speed, it is difficult to synchronize this insertion of the front plate.

From EP 0 709 330, there is known a booklet transfer device constituted by a carriage having two portions, a lower portion for driving in translation said carriage carrying an upper portion arranged to project into the stacking table to raise the printed booklets so as to transfer them, pneumatic drive means between the lower portion and the upper portion permitting raising and lowering the upper portion. Such a device thus has a transfer carriage whose length limits the length of the bundle of booklets to be transferred.

From EP 0 623 542, there is known a device to form horizontal bundles of booklets from a vertical arrival path.

This devices comprises a separator formed by two portions that can be portions that can be spaced apart, which is inserted within the flow of booklets, between two booklets, from below the stacking table and, once said separator is introduced, the two portions of the separator move apart while delimiting respectively a bundle formed and a bundle in the course of formation. The formed bundle can thus be taken up by a transfer device to bring it toward a pressing station. This transfer device is constituted by two movable elements positioned above the stacking table and that can slide along said stacking table to a banding station, each movable element being constituted by two portions which extend transversely to the direction of advance of the stacking table. These portions can slide relative to each other so as to be spaced on either side of the table and approach each other below the stacking table, thus interposing themselves on the stacking path. Because of this, when the movable element of the transfer device wears against the forward end of a bundle, the two portions of said element are brought together whilst the two portions of the movable element of the transfer device itself to be positioned at the end of a formed bundle are spaced on opposite sides of the stacking table and are brought together to serve as an abutment only when the separator has provided a separation within the flow of booklets.

This booklet formation device moreover provides emplacing, with the help of elements of the transfer device, end booklets for a bundle from a store located beside the stacking table, said plates being raised and brought over the stacking table with the help of transfer elements. Thus, the rear plate is introduced between the rear separation element of the formed bundle and the movable transport element for the rear end, the separation element is then withdrawn and the movable transfer element for the rear end maintains the rear plate against the end of the bundle.

Once the formed bundle is brought to another station, the two movable transfer elements trap between them a plate which they bring to the front end of the bundle undergoing formation, the movable element adapted to rest against the rear of the bundle spaces its two portions on opposite sides of the stacking table to free the plate facing the forward end of the bundle and the separation element resting against said front end can then be withdrawn below the stacking table, the plate resting against the front end of the movable transfer element for the front end.

Such a device has several drawbacks. On the one hand, it is of a relatively complicated and cumbersome structure from the point of view of the transfer device disposed above the stacking table, which must slide above and along the stacking path for the booklets and which moreover has elements sliding transversely to said path. This device requires a protective housing which prevents access of an operator to the bundle undergoing formation in order to conform to safety standards in force.

On the other hand, such a device, when it is applied to stacking devices for bundles that operate at high speed, has a relatively long processing cycle to the extent to which the emplacement phase of the plates using transfer means of the bundle, requires a certain time lapse which prolongs the length of the formation cycle of the bundles, which can be troublesome.

From AT 393 820, there is known a device for stacking printed booklets in the form of bundles, in which a bundle is formed by introduction of separation elements between two printed booklets. These separation elements are positioned above the stacking table and thus engage between two booklets from above the stack. The separation elements are carried by two separate and independent supports positioned above said stacking table so as to be driven in translation along and above said table. Thus, once the separation elements are introduced between two stacked booklets, these elements are spaced from each other so as to separate the printed booklets into a formed bundle and a bundle undergoing formation. This device moreover comprises abutment means positioned on the path of advance of the supports of the separation elements and which coact with the latter to permit the emplacement of the plates at the rear of a formed bundle and at the front of the bundle undergoing formation. Thus a plate is inserted between the separation elements at the rear of the formed bundle and those at the front of the bundle undergoing formation which arrives in such a way that, when the separation elements are retracted to the rear of the formed bundle, the plate is emplaced at the rear of the formed bundle and is held by the front of the bundle undergoing formation provided with the other separation elements, then the separation elements are again introduced at the rear of the plate. This type of device thus provides a separation within a stack with the help of separation elements driven separately, one moreover coacting with a bearing abutment to remove the formed bundle whilst the other is synchronized with the advance of the stacking table.

Such a device has drawbacks to the extent to which, for high stacking and transfer speeds, the emplacement of the plates leads to a too long cycle time, this emplacement using the stacking separation elements and an advancing time of the bundle undergoing formation. Moreover, a supplemental time is required to cause thereafter the additional transfer elements to intervene to take charge of the formed bundle and to drive it toward another station for processing so as to free the bearing abutment as well as the separation elements. Moreover, during emplacement of the plates, from a store which is to the side of the stacking table, the plate is positioned such that it can drive the booklets during its emplacement or can swing over said stacking table. Moreover, during introduction of the separation elements, there is risk of damaging the booklets. This device is moreover dangerous for an operator.

From EP 0 741 101, there is known a device for separation of packets of horizontally stacked booklets, in which there is provided a vertical arrival wall for the booklets on a stacking table, said wall being adapted to swing rearwardly relative to the stacking point of the booklets on said table, a first movable carriage below the stacking table having separation corners and separation teeth deployable above the stacking table, as well as a second carriage provided with abutment teeth and bearing teeth. To separate a formed bundle from the rest of the flow of booklets, the vertical wall is swung rearwardly whilst the carriage carrying the separation corners moves toward the formed bundle, the corners projecting above the stacking table coming into abutment against the lower edge of a booklet forming the last booklet of the bundle. The space formed by swinging of the vertical wall receives the following booklets, which accordingly fall by being separated from the last booklet of the formed bundle. The separation teeth secured to the separation corners and the abutment teeth of the second carriage are introduced between the last booklet of the formed bundle and the first booklet of the new bundle undergoing formation, whilst the bearing teeth of the second carriage rest in front of the bundle.

The formed bundle is then removed by the second carriage between the abutment teeth and the bearing teeth toward another stacking station whilst the first carriage moves with the new bundle undergoing formation bearing against the separation teeth, the vertical wall for arrival of the booklets being swung to its initial position. The second carriage is then returned with its abutment teeth retracted below the stacking table whilst its projecting bearing teeth come to rest at the front of the bundle undergoing formation. The separation teeth are then returned retracted below the stacking table and the separation carriage is returned to the stacking point of the booklets. In this type of device, the separation phase is triggered with the help of detectors when there is detected a predetermined length of bundle corresponding particularly to the length of the second carriage.

The second carriage can be constituted by two elements connected telescopically, which permits different lengths of carriage.

Such a device however does not offer a certain separation of one bundle in a continuous stacking flow, in particular on high speed stacking devices. Thus, the swinging of the vertical arrival paths for the booklets can give rise to important disturbances in the flow of the booklets and in the regularity of their horizontal stacking. Moreover, the introduction of the separating corners can also give rise to disturbances in that a back of a booklet can be pushed by said corners and no longer be correctly stacked.

Moreover, in this device, the emplacement of front and rear plates at the ends of the bundle is more often carried out after the line transfer of the bundle formed with the help of the second carriage. In this type of device, said emplacement of the plates can be carried out at the same station as the pressing of the bundle, the plates being emplaced with the aid of pressing grippers disposed in front of and behind the bundle. Because of this, in a device as described above, either one chooses not to press the bundle formed during its transfer, to avoid damaging the printed booklets directly in contact with the abutment and bearing teeth of the carriage and because of this, there is a slowed transfer speed, or one chooses a rapid transfer speed and presses the formed bundle despite the risk of damaging the booklets.

Moreover, a device comprising a telescopic carriage for the transfer of the bundle has the drawback of being limited in its capacity to approach and move away between the front end and the rear end, because of its construction.

In U.S. Pat. No. 4,824,093, there is disclosed a stacking device that does not have a vertical stacking head, the booklets being brought in the form of a layer and then raised by the oblique lateral abutments during their drive on a belt. Such a device is hence already very slow as to the point of view of stacking.

This device comprises three means for retaining the booklets, one in front of the booklet undergoing formation, the other at the rear whilst the third is in front of the formed bundle from an intermediate position over the stacking table, to which position a plate is distributed at the front of the bundle. A banding station is provided in line with the stacking table, in which station the bundle is brought between the third retaining means at the front and the second retaining means at the rear to come into abutment against a gripping means mounted on a jack. This gripping means against which the bundle abuts permits compressing the bundle in relation with the returning means disposed at the rear of the bundle.

Such a device cannot be used to form bundles of high quality at high speeds to the extent that there is not a stacking head but a lifting of the booklets, where the gripping must intervene after the bundle comes into abutment against a gripping means, and that moreover, the returning means coming before the bundle is limited in its movement such that the arrival of the front of the bundle must be awaited at a fixed point on the stacking table such that the latter will come into abutment against said retaining means. Moreover, the length of the bundle cannot be freely varied in the course of a same production, the second retaining means moving only over a portion of the stacking table and not over its total length.

All these horizontal stacking devices for booklets, in addition to the drawbacks set forth above, thus do not permit use in the case of high speed stacking. Moreover, the transfer means for the bundles or the bearing means against which a bundle undergoing formation rests, are generally limited as to their movement relative to the stacking table, which limits the freedom of choice of length of the bundles that can be produced by such a device.

Moreover, the pressing carried out by the pneumatic or hydraulic control means is imprecise and difficult to adjust, which can give rise to damage to the bundle.

In U.S. Pat. No. 4,772,003, there is disclosed a stacking device for booklets on an inclined stacking table comprising a first support receiving the forwardmost end and gradually lowering from the loading position of the booklets to an intermediate position over the stacking table, a second support taking over from this intermediate position to a discharge position of the bundle and a third support supporting the rear end along the stacking table, each support being arranged to operate in relation to the others.

At mid-trajectory of the stacking table, is disposed a plate distribution station. When a formed plate arrives at said plate distribution point, its rear end coincides with the plate distribution station which comprises a means for supplying the plate to the rear of the bundle behind the third support, the latter disappearing below the stacking table and the supply means for the plate remaining in place to hold the rear of the bundle provided with a plate.

Plate supply takes place for the front from the second support which comprises a recess in which a plate is distributed from the distribution station of the plate to the return for this support forwardly of a bundle undergoing formation. At the end of the stacking table, the second support at the front of the bundle comes into abutment against a fixed element mounted on this stacking table and this support placed in front of the bundle then retracts under the stacking table and leaves the plate at the front of the bundle against the fixed abutment element. Thus, the bundle is maintained provided with plates for the abutment element in front and by the emplacement means for the plates at the rear. The formed bundle is then driven toward the gripping station parallel to the stacking table and disposed along the latter, this bundle being disposed between two gripping plates connected to each other by jacks.

Such a device thus does not permit producing bundles of small and great lengths in the course of a same production, without it being necessary to stop the machine, for example to modify the position of the abutment element, and because the gripping members mounted with jacks can have only a maximum length and a minimum length. Moreover, such a device does not permit achieving high production rates, the emplacement of the plates taking time to the extent to which it is necessary that the bundle be brought into abutment against said abutment element so that the plate can be set in place at its end.

The invention has for its principal object to provide an automatic device for the horizontal stacking and transfer of booklets in the form of bundles, of a construction and design such that it permits easily carrying out stacking of the booklets, the separation of a bundle of said stacked booklets and its transportation, the transfer means of said device being such that there is a very good cycle time, a much greater freedom to drive them in translation along the table and such that their maximum or minimum lengths of spacing between their part resting at the front of a formed bundle and their part at the rear of a formed bundle, whilst the pressing of the formed bundle is ensured in an efficacious and precise manner with a greater liberty whilst leaving to an operator free access without danger to the bundle undergoing formation.

To this end, the invention has for its object an automatic device for the horizontal stacking and transfer of booklets in the form of bundles of stacked booklets, of the type comprising:

- a conveyor for supplying printed booklets in the form of a layer,
- horizontal stacking head for the booklets with a vertical path (1) for said booklets,
- stacking table on which the booklets rest on their backs,
- means arranged to form a separation between two stacked booklets so as to form a bundle of booklets,
- means for transferring a bundle of formed booklets, movable below and along the stacking table, comprising at least one bearing element projecting above the stacking table and retractable below the stacking table and against which the front end of a bundle presses, said bearing element being carried by a first carriage and at least one abutment element drivable between a retracted position below the stacking table and a projecting position above the stacking table, in which position said abutment element extends against the rear end of a formed bundle, said abutment element introducing itself between two separated booklets and being carried by a second carriage, said carriages being drivable below and along the stacking table,
- bearing element for a new bundle undergoing formation, carried by a third movable carriage below and along the stacking table, said bearing member being drivable between a retracted position below the stacking table and a position projecting above the table, and
- means for the distribution and emplacement of front and rear plates to the ends of a bundle from a store of plates, characterized in that the first carriage, the second carriage and the third carriage are drivable independently of each other in the direction of advance of the stacking table and in the opposite direction, in the course of stacking the booklets, the second and third carriages being respectively drivable for relative movement in the direction of advance of the stacking table and in the opposite direction relative to a plate emplaced transversely on the stacking table by the distribution and placement means for the plates disposed adjacent the stacking point, during the appearance of the separation space in the stacked booklets, to emplace a plate at the rear end of the formed bundle and a plate at the front end of the bundle undergoing formation.

Thus, in a particularly advantageous manner, the second and third movable carriages being drivable independently of each other in the direction of advance of the booklets and in the opposite direction, undergoing slowing and/or acceleration whilst the stacking and separation takes place, it is thus possible to make them coact with the distribution means for the plates such that the time of emplacement of the plates will be completely comprehended within the cycle time.

Preferably, the second and third carriages and also the first movable carriage are drivable independently of each other, preferably by electrical control means, which permits giving precisely to one or the other of them independent speeds of movement, different from each other and modifiable, to subject them to accelerations and/or slowings and to drive them in the direction of advance of the stacking table or in the opposite direction and this independently, each carriage being driven synchronously according to the different phases of operation of the device.

As a result, the formation of the bundle is promoted without risk of damage to the latter, in particular in the course of pressing and transfer of the formed bundle, because the device according to the invention permits emplacing the plates at the front and rear of a bundle during the appearance of the separation between a formed bundle and a bundle in formation, which is to say before the transfer of said formed bundle. This takes place preferably without the processing cycle being prolonged, which permits using in particular such a device as a high speed stacking and transfer device.

A device according to the invention thus permits emplacing plates at the ends of the bundle efficaciously, with certainty and rapidly, within a high speed production cycle.

Moreover, the device according to the invention permits emplacing the plates at the front end of a bundle undergoing formation and then at the rear end of a formed bundle in a manner totally independent of the length of the bundle. There is thus a much greater liberty than with the devices described above.

According to another advantage of the device according to the invention, the first and second movable carriages constituting the transfer means being totally independent in their driving and as to their direction of driving relative to the stacking table, it is possible to establish within the bundle, between these transfer carriages, a pressure adjustable by the respective speed of the second and third carriages. Thus, there is obtained a pressing of the motor driven cartridge.

Moreover, this pressing takes place no matter what the length of the cartridge, because the carriages being independent, there can be produced with the same device bundles of booklets of different lengths and, in theory, without limit as to length. Thus, the minimum spacing between the two carriages is more advantageous than in devices provided with telescopic transfer means.

Moreover, the bundle being pressed by its transfer means, there is a saving of time, the bundle not needing to be manipulated or sent toward other members to be pressed, which permits optimizing the cycle time.

Advantageously, it is also possible to establish or not a pressure within the bundle and to adjust said pressure as a function of the type of booklets transported. With the device according to the invention, it is thus possible to grip very strongly the booklets which are symmetrical and stable or very little a bundle of dissymmetrical booklets (for example having a thicker bend) which would collapse at the least longitudinal gripping exerted pneumatically by known means.

Preferably, the pressure is electrically adjustable by the respective speed of said carriages and the couple imposed by the electrical control means such as the motors of the two carriages. Moreover, the control of the motors can be carried out digitally. The adjustment and regulation of this pressure take place as a result in a finer and more precise manner than with the pneumatically or hydraulically controlled pressing means.

Preferably, the pressure applied is within the range of 0 to 500 kg.

The first and second carriages being disposed below the stacking table, access to said stacking table is possible because the bearing elements and abutment elements carried by said first and second carriages are retracted below the table, whether said carriages are movable or immovable. Thus, an operator can control visually a bundle undergoing formation and intervene as to said bundle undergoing formation, for example, to withdraw a torn or mispositioned booklet in said bundle without it being necessary to stop the device for reasons of safety and protection of the operator.

The bearing element projecting above the level of the stacking table and against which the front end of a bundle bears, being also retractable below the stacking table, when the first and second carriages are brought back toward the stacking head, no bearing or abutment element projects above the stacking table, which ensures greater safety to the assembly, in particular when an operator intervenes as to the bundle undergoing formation.

The means arranged to form a separation between two booklets so as to separate a stack of booklets into a formed bundle and a bundle undergoing formation, can be any suitable separation means and known per se. Preferably, the device according to the invention comprises as such means arranged to form a separation between two booklets, a separation device for booklets in the layer of arriving booklets so as to create a separation space between two booklets at the level of the stacking point.

Preferably, the distribution and emplacement means for a plate at the forward end of a bundle are the same as those for emplacing the plate at the rear end of the bundle and moreover comprise means for retaining booklets interposable within the path of advance of the stack adjacent the stacking point and coacting with the abutment element of the second movable carriage or the bearing member carried by the third movable carriage so as to create, between said retaining means interposed in the path of advance of the stack and said abutment element or said bearing member, a space for receiving a rear plate or respectively a front plate for a bundle, said retaining means being positioned such that said space is created in correspondence with the distribution means, known per se, for a plate from a store, the second movable carriage or the third movable carriage permitting respectively driving the abutment element or the bearing element such that the latter can trap the plate at the rear end of the formed bundle or at the front of the bundle undergoing formation.

Thus, preferably, the second movable carriage being driven in translation independently of the first movable carriage, said second movable carriage can move in translation to coact with the retaining means without disturbing the advance of the first movable carriage.

Preferably, the retaining means are constituted by two flaps disposed respectively on opposite sides of the stacking table and drivable in translation transversely to the direction of advance of the stacked booklets, approaching each other such that they are interposed into the path of advance of the stacking table and spaced from each other such that they interrupt and free the path of advance of the stack.

When a separation appears between two booklets, for example the appearance of a separation space stacking point, this separation or separation space is located before the retaining means on the stacking table.

The bearing element of the first movable carriage rests against the front end of the bundle which was just then in formation. The abutment element of the second movable carriage is then introduced at the rear end of the formed bundle at the level of the separation space and drives the rear of said formed bundle beyond the retaining means for the booklets in the direction of advance of the stack which, thus interposed within the direction of advance of the stack, form between them and the abutment element of this second carriage, a reception space into which the distribution means of a plate introduce a plate, said abutment element then retracting below the stacking table and being driven by the second movable carriage to move in the opposite direction from the direction of advance, to come into coincidence with or to the rear of the retaining means between which said abutment element is again brought into projection above the stacking table behind the rear plate and the rear end of the formed bundle. The bundle is then removed by said first and second movable carriages toward a packaging station such as a banding station whose banding tunnel is positioned in line at the end of the stacking table.

Thus, when the plate is introduced between the retaining means and the abutment element of the second movable carriage, the latter can be withdrawn below the stacking table to the extent to which the retaining means hold the plate and the booklets of the rear end of the bundle, thus avoiding the collapse of the stack of booklets, the time that the abutment element will be again brought into projecting position behind the plate.

Preferably, the second movable carriage being driven independently relative to the first movable carriage whose bearing element extends against the front end of the formed bundle, there is impressed a greater speed on said second movable carriage to drive the rear of the formed bundle beyond the retaining means and to return said abutment element behind the distributed plate such that this distribution and this emplacement of the rear plate take place in a very reduced time or substantially within the cycle time.

Preferably, the bearing member carried by the third movable carriage is also introduced between two separated booklets, for example in the separation space at the stacking point, so as to rest against the front end of a new bundle in formation and, when it arrives adjacent or at the retaining means interposed into the stacking path, said bearing member is driven by the third movable carriage beyond said retaining means so as to create a space between said retaining means and said bearing member, in which space the distribution means for a plate introduce a plate for the front end of the bundle undergoing formation, said bearing member being then retracted substantially in coincidence with the retaining means so as to trap the front plate whilst the retaining means are actuated to free the path of advance of the stack.

Thus, the booklets of the bundle undergoing formation are retained by the retaining means interposed in the stacking path whilst the bearing member is spaced from the front of the bundle. Preferably, the emplacement of the plate takes place also in a time overlapping the cycle time for the bundle, because this emplacement of the plate takes place in the course of the formation of the bundle whilst the preceding bundle is transported. Moreover, there is obtained an emplacement of the plate with a precision and reliability totally independent of the speed of production of the booklets which arrive, the driving of the bearing member by its movable carriage being thus totally independent of the speed of advance of the bundle undergoing formation and not disturbing it.

According to a second embodiment, the distribution means for the plates are positioned adjacent the stacking table near the stacking point and are constituted by a store of plates and a gripper for a plate mounted at the end of an articulated arm, said gripper bringing successively two plates into the separation space created between a formed bundle and a bundle undergoing formation, one at the rear of the formed bundle, the abutment element retaining the rear of the bundle being retracted below the bundle and being driven by the second carriage which brings it to the rear of the plate held by the gripper across the stacking table, said abutment element being again brought into protruding relationship and returned to the rear of the bundle, thereby trapping the plate, and the other plate at the front of the bundle undergoing formation, the gripper bringing the second plate into the separation space, which is to say in front of a bundle undergoing formation, the bearing member at the front of said bundle being retracted below the table and driven by the third carriage beyond the plate then being driven again to project above the table to press against said plate at the front of a bundle.

These distribution means permit positioning the plate in a reliable manner and the actuation of the gripper can be anticipated which permits improving further the gain of time in the course of the cycle. Moreover, the rear plate is emplaced very soon in the cycle, which permits carrying out a stacking path at a banding station without interruption, hence more rapidly because there is only a single acceleration and deceleration for all of the path.

Moreover, this embodiment has a supplemental advantage relative to the first embodiment, to the extent to which the emplacement of the plate at the front no longer depends on the passage between the retaining flaps, which permits carrying out this emplacement of the front plate in an asynchronous manner relative to the ejection of the formed bundle.

All the movements for emplacing the plate at the front of the bundle and at the rear of said bundle are carried out in perfect synchronization with the relative stacking speed, this synchronization being possible because of the control of the speeds of movement of the independent movable carriages, in particular because of the digital control of the control of the speeds of the motors driving said carriages.

In particular, with the aid of certain motor technologies, there is obtained a stopping of the motor with blockage and complete preservation of the pressure within the bundle.

Preferably, with the device according to the invention, there is thus obtained a formed bundle having a plate at its two ends such that it is possible, without damaging the bundle, to press it between the two movable carriages upon the ejection of the bundle and to impose a high transfer speed in the course of transfer in line of the bundle toward another station by sliding said bundle along the stacking table. This device is thus appropriate for use as a device for stacking booklets, for forming bundles of said booklets, and for transferring said bundle at a high speed.

Preferably, there is emplaced at the end of the stacking table a packaging station such as a banding station which thus is located in line with the stacking device according to the invention, the first and second carriages of said device driving in line a formed cartridge up to said banding station.

According to a preferred embodiment of the device according to the invention, the abutment element of the second movable carriage is in the form of at least one abutment finger drivable between a position in which it projects above the stacking table and a position in which it is retracted below the stacking table, a belt whose ends are fixed to the carriage being rolled about the finger while passing through the upper end and the lower end of said finger provided respectively with rotatable rollers such that, during projection of an abutment finger above the stacking table to come into abutment against the rear end of the formed bundle, the ends of the finger will roll along the loop formed by the belt and said belt driven by the finger applies its surface against the surface of the booklet and, during retraction of said finger, the belt unrolls and spaces itself from the surface of said booklet. The surface of the belt thus remains immovable relative to the surface of the booklet, which is to say without sliding, during introduction or retraction of the abutment finger.

Preferably, the bearing element of the first movable carriage is in the form of at least one bearing finger of a type known per se or is made in the same manner as an abutment finger as described above.

Preferably, each flap of the retaining means for the booklets also has at least one belt forming a loop surrounding said flap, the ends of the belt being fixed relative to said flap such that the flap moves in said belt and when the booklets come into abutment against said flaps, the belt is applied against the surface of the booklets and when the flaps move apart on opposite sides of the stacking table to free the booklets, the belt unrolls and spaces itself from the surface of the booklets without friction against said booklets.

There is thus reduced any risk of damaging or spotting the booklets as a result of friction or sliding of the finger or fingers of the flaps against the booklets during sliding movement of said abutment or bearing fingers or retaining flaps.

Figure 1B:
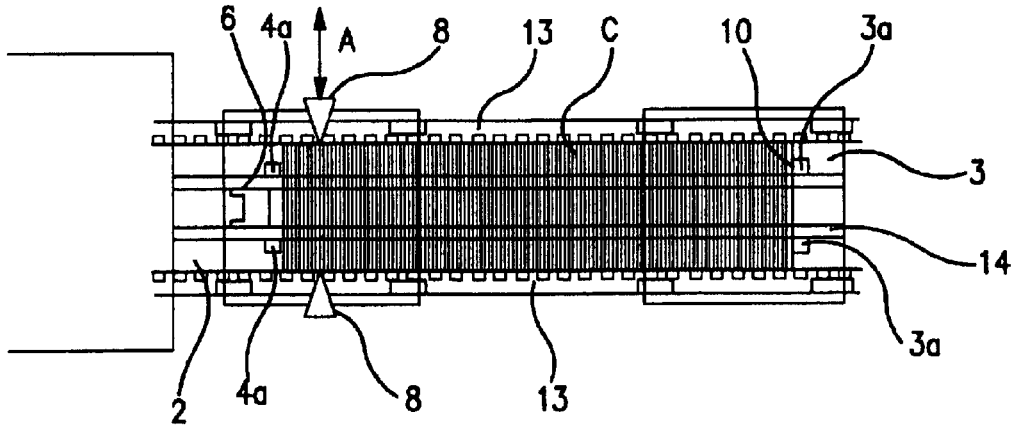
Figure 2A:
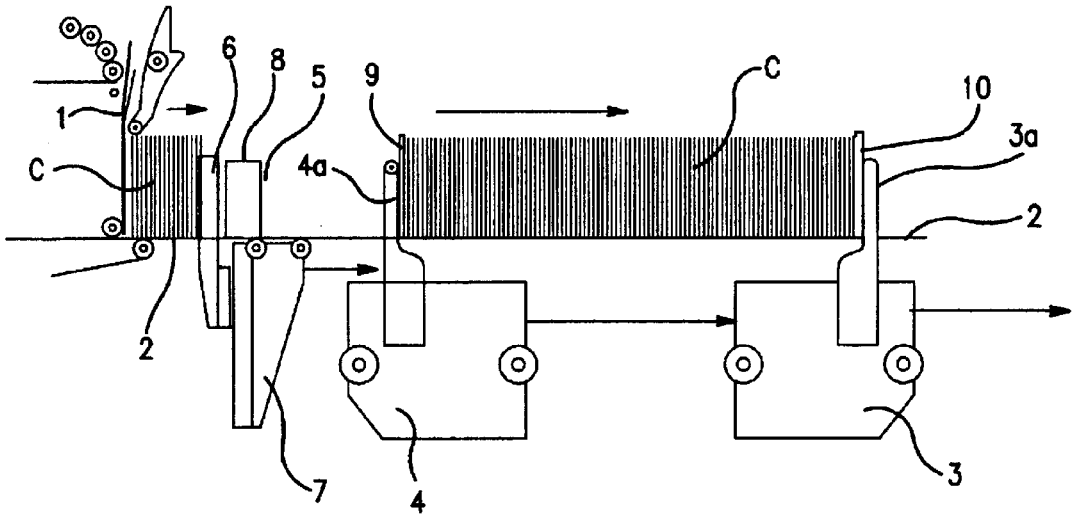
Figure 2B:
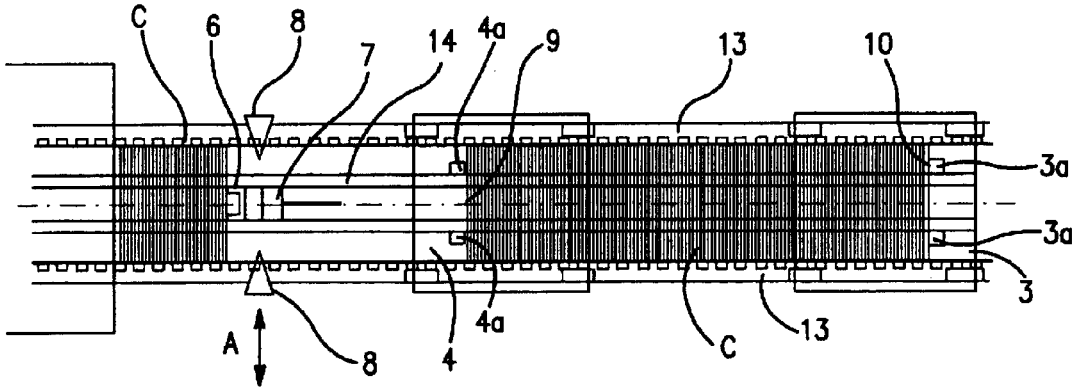
Figure 3A:
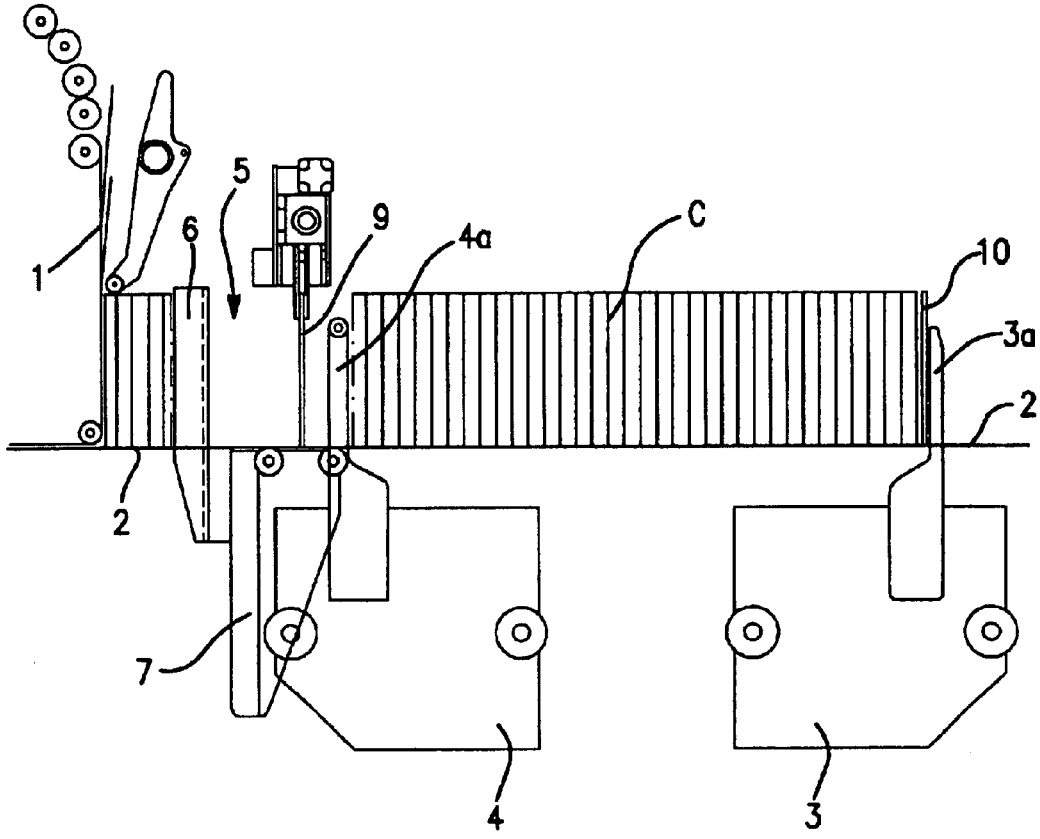
Figure 3B:
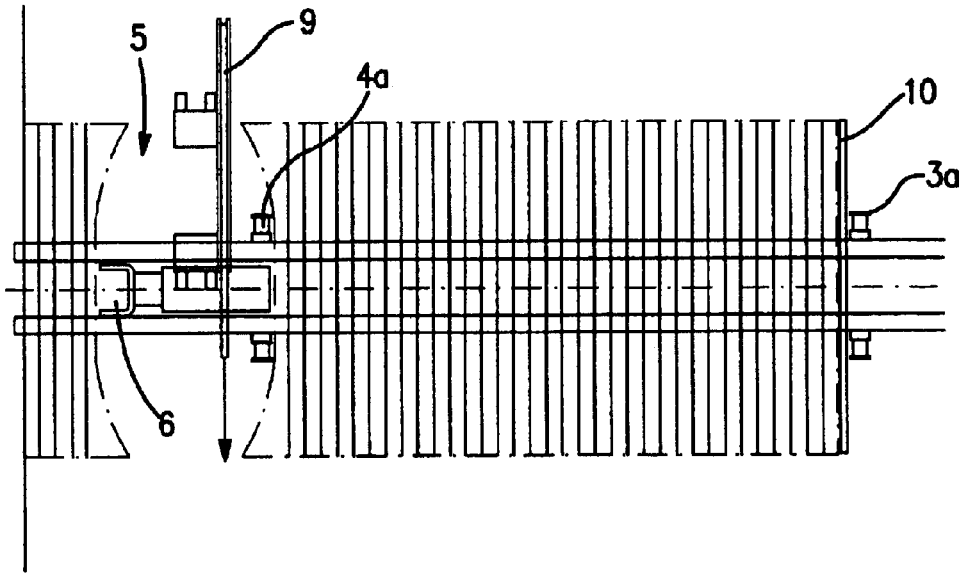
Figure 4A:
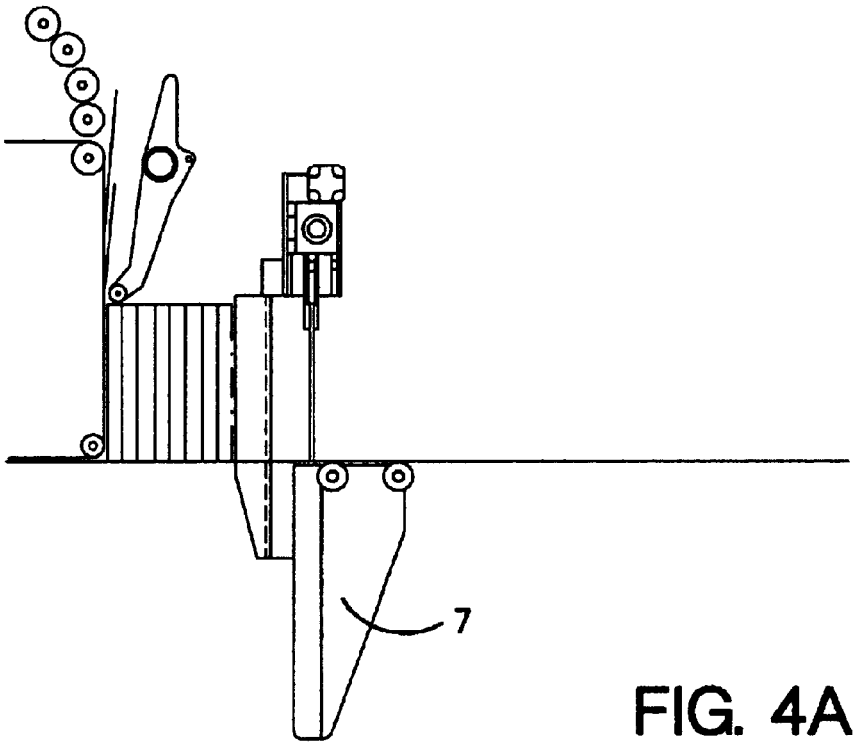
Figure 4B:
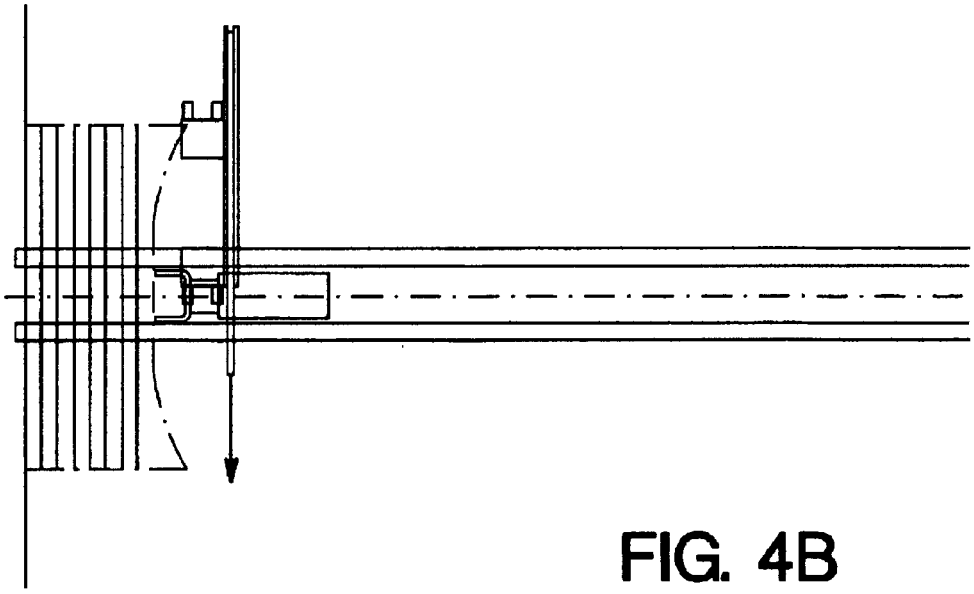
Figure 5B:
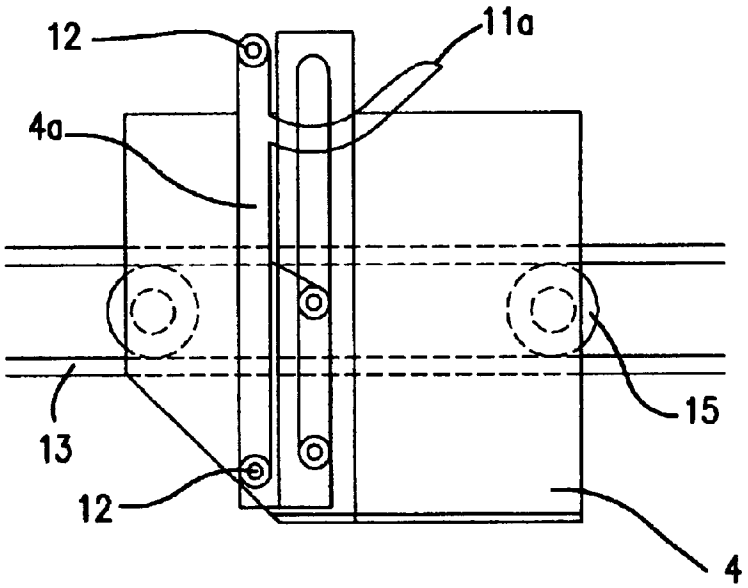
Figure 5A:
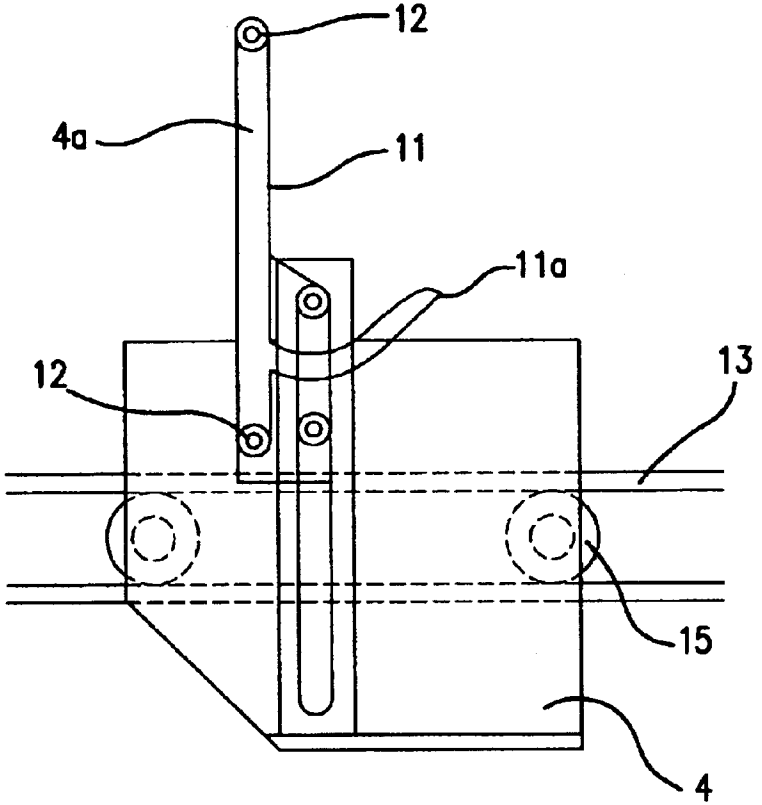
Figure 6A:
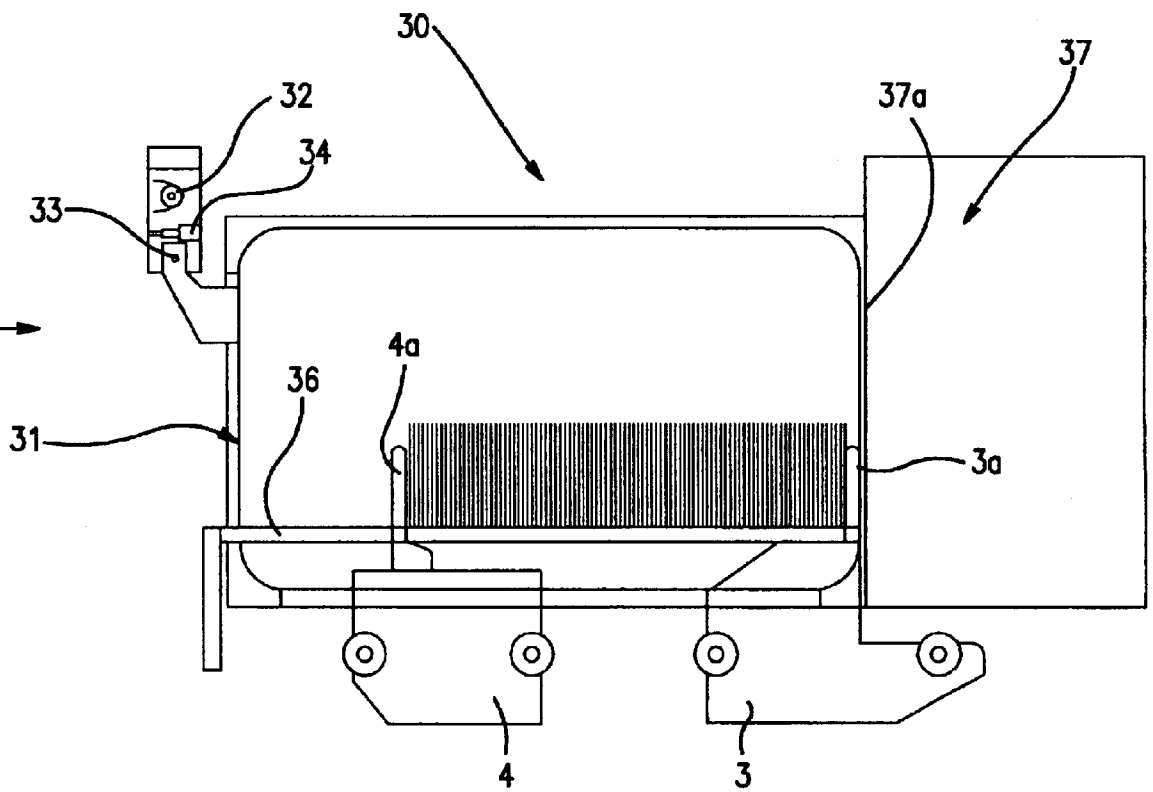
Figure 6B:
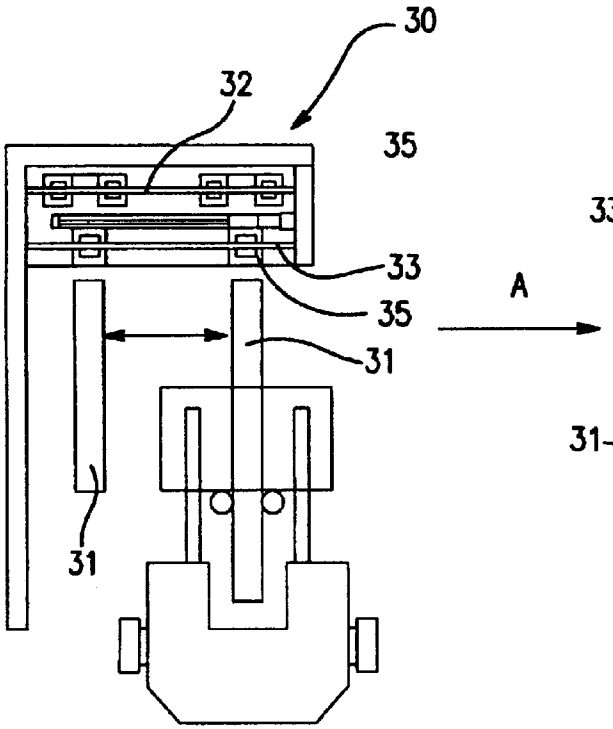
Figure 7A:
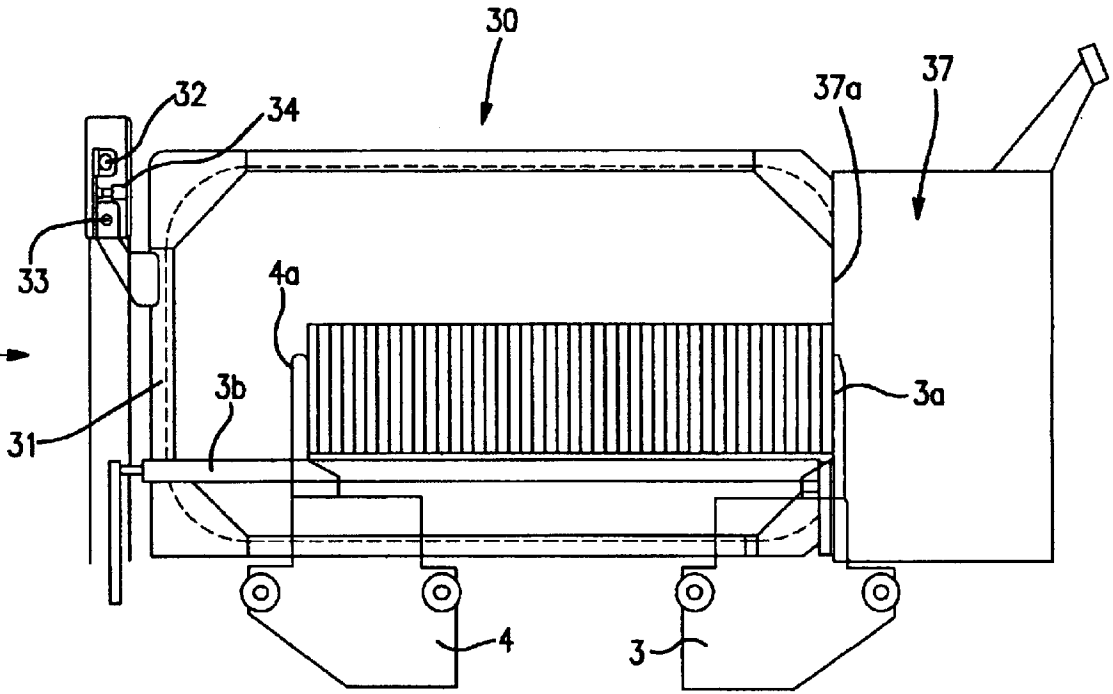
Figure 7B:
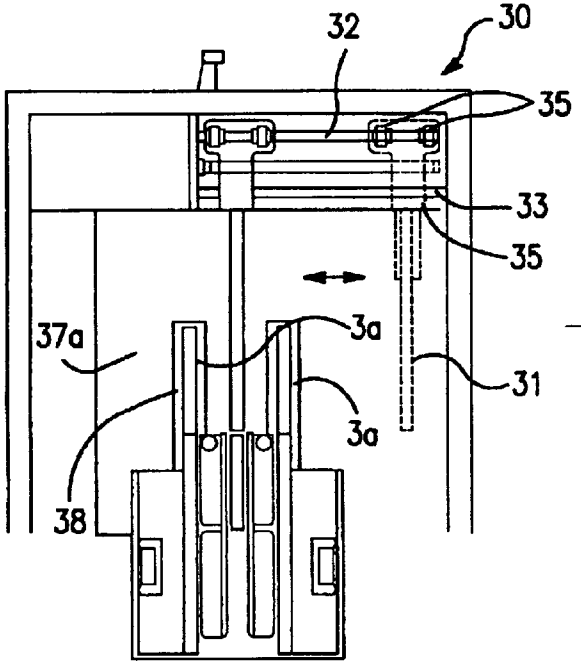

The invention will now be described in greater detail with reference to the accompanying drawings, in which:

FIGS. 1*a* and 1*b* represent respectively a side view and a top view of a portion of the device according to a first embodiment of the invention during the appearance of a separation space in the stack;

FIGS. 2*a* and 2*b* show respectively a side view and a top view of the device according to FIGS. 1*a* and 1*b* during disengagement of the formed bundle;

FIGS. 3*a* and 3*b* show respectively a side view and a top view of a device according to a second embodiment of the invention during the appearance of a separation space in the stack;

FIGS. 4*a* and 4*b* represent respectively a side view and a top view of a device according to FIGS. 3*a* and 3*b* during disengagement of the formed bundle;

FIGS. 5*a* and 5*b* represent a side view of an abutment finger of the second carriage of a device according to the invention;

FIGS. 6*a* and 6*b* show respectively a side view of the banding station of a device according to the invention and a front view of said station; and FIGS. 7*a* and 7*b* show respectively a side view of a modification of the banding station of a device according to the invention and a front view of said station.

FIGS. 1*a*, 1*b*, 2*a*, 2*b*, 3*a*, 3*b*, 4*a* and 4*b* show, for reasons of clarity, only a portion of the stacking device according to the invention, the arrival path of the booklets in a layer, the means arranged to form a separation between two booklets in the example shown here a separation device for booklets within the supply layer and the packaging station at the outlet of the device not being represented to the extent to which they can be of known types.

The stacking head, which can of a type known per se, is also shown in a fragmentary manner, FIGS. 1*a*, 1*b*, 2*a*, 2*b*, 3*a*, 3*b*, 4*a* and 4*b* showing only the vertical arrival path 1 of the booklets C to the stacking point on the stacking table 2.

The device according to the invention comprises transfer means permitting bringing a formed bundle to another treatment station for the formed bundle, such as a banding station.

These transfer means are constituted by first and second carriages independently movable below and along the stacking table 2. The first movable carriage 3 comprises a bearing element constituted by at least one bearing finger 3*a*, preferably two, projecting above the stacking table 2 and adapted to extend against the front end of a bundle. Preferably, the bearing fingers 3*a* are retractable below this stacking table 2.

A bearing member 6 to receive the booklets C for a new bundle undergoing formation, is carried by a third carriage 7 movable below and along the stacking table 2.

The second movable carriage 4 is positioned behind the first movable carriage 3 in the direction of advance of the stacking table 2 and carries an abutment element 4*a* drivable slidably relative to said carriage 4 between a position in which it is retracted below the stacking table 2 and a position in which it projects above the stacking table 2 so as to come into abutment against the rear end of a formed bundle.

A bundle is formed when a separation space 5 appears within the stack, resulting from the action of the separation means of the booklets in the arriving layer.

When the separation space 5 appears on the stacking table 2, the abutment element 4*a* of the second movable carriage 4 positioned below the stacking table 2 adjacent the stacking point is driven in a synchronous manner to project above said table 2 within the separation space 5 so as to come into abutment against the last stacked booklet before this separation space 5, the bearing fingers 3*a* resting against the front of the bundle.

Similarly, there is introduced into this separation space 5 the bearing member 6 to receive the booklets from the new bundle undergoing formation, arriving after the separation space 5. This bearing member 6 is carried by the third carriage 7 and is drivable slidably relative to said carriage 7 between a position retracted below the table 2 and a position projecting above the table 2.

The two carriages 3 and 4 of the transfer means and the carriage 7 of the bearing member 6 are drivable below and along the stacking table, in the advancing direction of said table and in the opposite direction, independently from each other and preferably with the help of electrical control means.

Preferably, the carriages 3 and 4 move in guided fashion along longitudinal rails 13 positioned below the table 2 substantially in vertical alignment with the longitudinal edges of the table 2, whilst the third movable carriage 7 is guided along a longitudinal rail substantially at the center of the table 2. The carriages 3 and 4 are provided with rotatable rollers 15 guided along said rails 13, 14. Any other suitable drive means and of known type can be used.

Preferably, the abutment element 4*a* of the second transfer carriage 4 is in the form of two abutment fingers drivable between a position in which they project above the stacking table 2 and a position in which they are retracted below the stacking table 2.

A belt 11, whose ends 11*a* are fixed to the carriage 4, is wound about each finger 4*a* by passing through the upper and lower end of said finger 4*a* provided respectively with rotatable rollers 12. Thus, during projection, an abutment finger 4*a* above the stacking table 2 comes into abutment against the rear end of the formed bundle, the ends of the finger 4*a* roll along the loop formed by the belt 11 and said belt 11 driven by the finger 4*a* applies its surface against the surface of the booklet C and, during retraction of said finger 4*a*, the belt 11 unrolls and spaces itself from the surface of said booklet C.

Thus, the surface of the belt 11 always remains stationary relative to the surface of the booklet C, which is to say without sliding, during introduction or retraction of the abutment finger 4*a*.

The bearing fingers 3*a,* retractable below the stacking table 2, can be of a type known per se or they can be made of the same material as the abutment fingers 4*a*.

The device according to the invention moreover comprises means for distribution and emplacing of plates at the two ends of a bundle before the transfer of the latter.

According to one embodiment shown in FIGS. 1*a,* 1*b,* 2*a* and 2*b,* the means are constituted by a store for plates and distribution means for the plates known per se (not shown), as well as means for retaining booklets which can be interposed in the path of advance of stacking.

These retaining means, each comprising at least one belt functioning as the belt 11 of the abutment element, coact either with the abutment element 4*a* to form a space in which is introduced a plate at the rear end of a formed bundle, or with the bearing member 6 to form a space in which is introduced a plate for the front end of a bundle undergoing formation.

These retaining means that can be introduced into the path of advance of the stack are constituted by two flaps 8, also called cones, positioned on opposite sides of the stacking table 2 and drivable to move transversely to the direction of advance of the stacking table by approaching and retracting from each other (according to the double arrow A in FIGS. 1*b* and 2*b*), the flaps 8 being thus respectively interposed in the path of advance of the booklets C or withdrawn from said path.

The device of the present invention operates in the following manner: the booklets C are brought in the form of a layer of booklets C to a horizontal stacking head along a vertical supply path 1 and there is carried out, for example, a separation between two booklets in the layer before the arrival at the stacking head, such that a separation space 5 will be created within the booklets stacked horizontally on the stacking table 2 at the outlet of the stacking head at the point of stacking.

There is brought, to the front end of a bundle undergoing formation, the first carriage 3 movable below the stacking table 2 such that the bearing fingers 3*a* that it has, rest against the front of the bundle undergoing formation provided with a front plate 10, the second movable carriage 4 being returned below the stacking table 2 to adjacent the stacking point, its abutment element 4*a* being withdrawn below the table 2.

When the separation space 5 appears in the stack of booklets C, there is introduced therein the abutment element 4*a* projecting above the table 2, said abutment element 4*a* then resting against the rear end of the first stacked booklet of the bundle thus formed. The second movable carriage 4 thus drives the rear end of the bundle beyond the retaining means or flaps 8 for the booklets C in the path of advance of the stack, said retaining means 8 being thus positioned so as to be interposed within the path of advance to the rear of the bundle. There is then introduced, from a store (not shown) positioned correspondingly along the stacking table 2, a rear plate 9 between the retaining means 8 and the abutment element 4*a* at the rear of the bundle, said abutment element 4*a* is retracted below the stacking table 2 and the second movable carriage 4 thus brings said abutment element 4*a* substantially into coincidence with the retaining means 8 behind the plate 9 where it is again driven to protrude above the table 2. The retaining means 8 are retracted from the path of advance of the stack and the abutment element 4*a* thus extends against the rear plate 9 positioned at the end of the formed bundle.

In this sequence, the carriage 3 advances independently of the carriage 4 but in a manner synchronized with the latter.

This bundle has a front plate 10 and a rear plate 9 and the first and second movable carriages 3, 4 can thus transfer said bundle whilst gripping it, toward a banding station for example, constituted by a banding tunnel 30 positioned at the end of the stacking table. In the banding station, once the bundle is banded, the bearing fingers 3*a* of the first movable carriage 3 and the abutment fingers 4*a* of the second movable carriage 4 can be retracted below the stacking table 2 in the banding tunnel 30, said first and second movable carriages 3, 4 being then returned toward the stacking head 1 whilst leaving available the access to the stacking table 2 whilst the banded bundle is ejected toward another station, for example a palletization station. Thus, an operator intervening in a bundle undergoing formation does not prevent the return of said carriages 3, 4 toward the stacking head 1 and does not risk being wounded by the bearing fingers 3*a* or by the abutment fingers 4*a* projecting above the stacking table 2.

During the appearance of the separation space 5 within the stacked booklets, there is also introduced the bearing member 6 carried by the third movable carriage 7, which was until then retracted below the stacking table 2, and which thus serves to bear against the booklets of the new bundle undergoing formation. This bearing member 6, when it arrives substantially in coincidence with the retaining means 8 that are in position interposed in the path of advance of the stack, is driven by its movable carriage 7 beyond said retaining means 8 so as to space itself from the front of the bundle undergoing formation. A plate 10 is then introduced into the space between the retaining means 8 and the bearing member 6. The bearing member 6 is then returned to the vicinity or into coincidence with the returning means 8 that are retracted from the path of advance of the stack, the bundle in formation having a front plate 10.

Once the plate 10 is in place, the bundle continues its advance on the stacking table 2 and, when the first movable carriage 3 of the transfer means is returned after having transferred a bundle, its bearing fingers 3*a* are retracted below the stacking table 2 and are brought to project above said stacking table 2 to come to rest against the front plate 10 of the bundle undergoing formation. The bearing member 6 which until then held the bundle undergoing formation, is retracted below the stacking table 2 and is returned by the third movable carriage 7 to the stacking point of said table 2 so as to be introduced into a new separation space 5.

The insertion space for the front plate 10 or rear plate 9 is thus always beyond the returning means 8 in the direction of advance in correspondence with the distribution means for the plates 9, 10.

In FIGS. 3*a,* 3*b,* 4*a* and 4*b* is shown another embodiment of the plate distribution means. These are positioned adjacent the stacking table 2 adjacent the stacking point and are constituted by a store of plates (not shown) and a gripping member 20 for a plate 9, 10 and mounted at the end of an articulated arm (not shown).

The gripper 20 brings successively to plates 9, 10 into the separate space created between a formed bundle and the bundle undergoing formation, a plate 9 at the rear of the formed bundle and the other plate 10 at the front.

Thus, when the separation space 5 appears between two booklets forming a formed bundle and a bundle undergoing formation, the gripper 20 brings a first plate 9 into said space 5, the plate 9 extending transversely to the stacking table 2 (FIGS. 3*a,* 3*b*). The abutment element 4*a* retaining the rear of the bundle is then retracted below the table 2 and the second carriage 4 is brought below the stacking table 2 behind the plate 9 maintained by the gripper 20 across the stacking table 2.

The abutment element 4*a* is again brought to project and is driven by the carriage 4 at the rear of the bundle, thus trapping the plate 9 at the rear of the formed bundle, which can be ejected by the first and second carriages 3, 4.

Another plate 10 is then brought by the gripper 20 into the space 5 in front of the bundle undergoing formation, the bearing member 6 at the front of said bundle being then retracted below the table 2 and driven beyond the plate 10 by the third carriage 7. Said bearing member 6 is then driven again to project above the table 2 and then brought toward the front of the bundle undergoing formation to be applied against said plate 10 at the front of the bundle undergoing formation (FIGS. 4*a*, 4*b*).

Preferably, the banding station is constituted by a banding tunnel 30 positioned in line with the end of the stacking table 2 such that the first and second carriages 3, 4 bring in line a formed bundle into said banding station 30 whose reception surface for the bundle is constituted by rollers 36 drivable in rotation extending longitudinally at the outlet of the stacking table 2, the carriages 3 and 4 being adapted to be positioned below the rollers 36 and the bearing element 3*a* and the abutment element 4*a* being engaged between two rollers 36.

This banding tunnel 30 preferably has a closure arm 31 emplaced when a bundle is brought into said tunnel 30. This closure arm 31 is positioned at the inlet end of the tunnel so as to extend vertically between the upper portion and the lower portion of said tunnel and is slidably mounted in translation along at least one axle 32, 33 transverse to the tunnel 30, between an open position of the tunnel 30 (left position in FIG. 4*b*) in which it is driven to be spaced from said opening, and a closure position (right position in FIG. 4*b*) in which it is interposed in said opening of the tunnel 30.

Thus, the closure arm 31 is slidably mounted in translation along at least one guide axle 32, 33 transverse to the banding tunnel 30 so as to extend vertically between the upper portion and the lower portion of the tunnel at the inlet of said tunnel and is driven to slide along said axle 32, 33 by a jack 34, preferably a rodless jack to which it is connected.

Preferably, the closure arm 31 is mounted, with the help of wall sockets 35 on two parallel guide axles 32, 33 extending transversely to the tunnel 30 in its upper portion and is connected also with a jack 34, preferably rodless, drivable in translation from left to right and from right to left as can be seen in FIGS. 4*a* and 4*b*. Such a sliding movement of the closure arm 31 is thus obtained in a simple and rapid manner, in a time that overlaps the removal of the bearing element 3*a* and abutment element 4*a* holding the bundle.

Such a banding tunnel 30 permits particularly not lengthening the cycle time for treatment of a bundle. Moreover, once the bundle is banded, the abutment and bearing elements 4*a*, 3*a* are retracted below the reception surface of the tunnel so as to be returned to the stacking head to take on a new bundle whilst the driving in rotation of the rollers 36 of the reception surface of the banding tunnel permits driving the bundle toward another station.

The banding tunnel 30 has at its end the bander 37 (FIG. 6*a*). During banding, the front end of the bundle is spaced from the bander 37 by the thickness of the fingers 3*a* carried by the carriage 3. There will thus be observed a deflection due to the tension of the binding and a relaxation of the binding due to the position of the weld of the binding which is located behind said bearing fingers 3 in the binder 37, this welding being pressed then under the influence of the tension.

According to a preferred embodiment of the banding station, the bander 37 has, on its wall 37*a* facing the front end of the bundle, notches 38 in which the fingers 3*a* constituting the bearing element carried by the first carriage 3 engage. In this way, the plane of the front end of the bundle and the plane of the bander are made to coincide. There is thus no deflection, or it is at least greatly decreased, because the weld is carried out in alignment with the plane of the bundle. It is thus not necessary to stretch as strongly as before, for a same result of tension in the banded bundle.

Preferably, the synchronized control of the action of all the members constituting the device according to the invention is obtained by an electronic control unit with the help of suitable means known per se.

There is obtained according to the invention a device whose emplacement of the plates principally in overlapping time, the pressing and transfer of the bundle in line, upon ejection of the bundle and the stacked portion and whose speed of transfer of the bundle as well as the force of pressing is easily adjustable such that this device can preferably be used with high speed stackers.

What is claimed is:

1. Automatic device for horizontal stacking and transfer of booklets in the form of bundles of stacked booklets, of the type comprising:

conveyor for supplying printed booklets (C) in the form of a layer, horizontal stacking head for the booklets (C) with a vertical arrival path (1) for said booklets, stacking table (2) on which the booklets (C) rest on their backs, means arranged to form a separation between two stacked booklets so as to form a bundle of booklets (C), means for transferring a formed bundle of booklets, movable below and along the stacking table (2), comprising at least one bearing element (3*a*) projecting above the stacking table (2) and retractable below the stacking table (2) and against which bears the front end of a bundle, said bearing element being carried by a first carriage (3) and at least one abutment element (4*a*) drivable between a position retracted below the stacking table (2) and a position projecting above the stacking table (2), in which position said abutment element (4*a*) extends against the rear end of a formed bundle, said abutment element (4*a*) being introduced between two separated booklets (C) and being carried by a second carriage (4), said carriages (3, 4) being drivable below and along the stacking table (2), bearing element (6) for a new bundle undergoing formation carried by a third movable carriage (7) below and along the stacking table, said bearing member (6) being drivable between a position retracted below the stacking table and a position projecting above the table, and means for the distribution and emplacement of front and rear plates at the ends of a bundle from a store of plates, characterized in that the first carriage (3), the second carriage (4) and the third carriage (7) are drivable independently of each other in the direction of advance of the stacking table (2) and in the contrary direction in the course of stacking the booklets, the second and third carriages (4, 7) being respectively drivable with the relative movement in the direction of advance of the stacking table and in the opposite direction relative to a plate emplaced transversely on the stacking table by the distribution means and the means for emplacing plates disposed adjacent the stacking point, during the appearance of the separation space in the stacked booklets, to emplace a plate at the rear end of the formed bundle and a plate at the forward end of the bundle undergoing formation.

2. Device according to claim 1, characterized in that the three movable carriages are drivable by electrical control means.

3. Device according to claim 1, characterized in that the first and second carriages (3, 4) constituting the transfer means, establish within a formed bundle a pressure adjustable by the speed of said carriages (3, 4).

4. Device according to claim 3, characterized in that the pressure is electrically adjustable by the respective speed of said carriages (3, 4) and the couple imposed by electrical control means of said carriages (3, 4).

5. Device according to claim 1, characterized in that the abutment element **(4*a*) of the second movable carriage (4) and/or the bearing element (3*a*) of the first movable carriage (3) are in the form of at least one abutment finger (4*a*) or bearing finger (3*a*) drivable between a position in which it projects above the stacking table (2) and a position in which it is retracted below the stacking table (2), a belt (11) whose ends (11*a*) are fixed to the carriage (3, 4) being rolled about each finger (3*a*, 4*a*) while passing through the upper end and the lower end of said finger (3*a*, 4*a*) provided respectively with a rotatable roller (12) such that, during projection, of an abutment finger (4*a*) or a bearing finger (3*a*) above the stacking table (2) to come into abutment against the rear end of the formed bundle and/or against the front end, the ends of the finger (3*a*, 4*a*) rolling along the loop formed by the belt (11) and said belt (11) driven by the finger (3*a*, 4*a*) applies its surface against the surface of the booklet and, during retraction of said finger (3*a*, 4*a*), the belt (11)** unrolls and spaces itself from the surface of said booklet.

6. Device according to claim 1, characterized in that it comprises as means arranged to form a separation between two booklets, a separation device for booklets in the arrival layer of the booklets (C) so as to create a separation space (5) between two booklets (C) at the stacking point.

7. Device according to claim 1, characterized in that the distribution and emplacement means for the plates (9, 10) comprise retaining means (8) for the booklets interposable in the path of advance of the stack adjacent the stacking point and coacting with said abutment element **(4*a*) of the second movable carriage (4) or said bearing element (6) carried by the third movable carriage (7) so as to create, between said retention means (8) interposed in the path of advance of the stack and said abutment element (4*a*) or said bearing member (6), a space for reception of a rear plate (9) or respectively a front plate (10) for a bundle, said retaining means (8) being positioned such that said space is created in correspondence with the distribution means for a plate (9, 10) from the store of plates, the second movable carriage (4) or the third movable carriage (7) permitting respectively driving the abutment element (4*a*) or the bearing member (6)** such that the latter can trap the plate at the rear end of the formed bundle or at the front end of the bundle in formation.

8. Device according to claim 7, characterized in that the retaining means are constituted by two flaps (8) disposed respectively on opposite sides of the stacking table and drivable in translation transversely to the direction of advance of the stacked booklets (C) to approach each other such that they are opposed in the path of advance of the stacking table (2) and away from each other such that they withdraw and free the path of advance of the stack.

9. Device according to claim 1, characterized in that the distribution means for plates are constituted by a store of plates and a gripper (20) for a plate (9, 10) mounted at the end of an articulated arm, said gripper (20) bringing successively two plates (9, 10) into the separation space (5) created between a formed bundle and a bundle in the course of formation, one plate (9) at the rear of the formed bundle, the abutment element **(4*a*) retaining the rear of the bundle being retracted below the table (2) and being driven by the second carriage (4) which carries it to the rear of the plate (9) maintained by the gripper across the stacking table (2), said abutment element (4*a*) being again brought to project and to return to the rear of the bundle, thereby trapping the plate (9), and the other plate (10) at the front of the bundle undergoing formation, the gripper (20) bringing the second plate (10) into the separation space (5), which is to say at the front of a bundle undergoing formation, the bearing member (6) at the front of said bundle being retracted below the table (2) and driven by the third carriage (7) beyond the plate (10) then being driven again to project above the table (2) to come into engagement against said plate (10)** at the front of the bundle.

10. Device according to claim 1, characterized in that it comprises a banding tunnel (30) positioned in line at the end of the stacking table (2) and in which a bundle is brought by the first and second carriages (3, 4), said tunnel (30) having a closure arm (31) positioned at the inlet end of the tunnel (30) so as to extend vertically between the upper portion and the lower portion of said tunnel (30) and is slidably mounted in translation along at least one axle (32, 33) transverse to the tunnel (30) between an open position of the tunnel (30) in which it is driven away from said opening and a closure position in which it is interposed in said opening of the tunnel (30).

11. Device according to claim 10, characterized in that the closure arm (31) is slidably driven along said axle (32, 33) under the influence of a jack (34) with which it is connected.

12. Device according to claim 10, characterized in that the bander (37) has on its wall **(37*a*) facing the front end of the bundle, notches (38) in which the fingers (3*a*) constituting the bearing element carried by the first carriage (3) engage so as to make the plane of the front end of the bundle and the plane of the bander (37)** coincide, welding being carried out in alignment with the plane of the bundle.

* * * * *